United States Patent [19]

Wilson, Jr. et al.

[11] 3,970,448

[45] July 20, 1976

[54] LOW ALLOY DIE STEEL (TYPE F)

[76] Inventors: William Wilson, Jr., 3308 N. New England Ave., Chicago, Ill. 60634; Charles W. Finkl, 2652 Sheridan Road, Evanston, Ill. 60436

[22] Filed: June 14, 1973

[21] Appl. No.: 369,922

[52] U.S. Cl. ..... 75/129; 75/49; 75/128 R

[51] Int. Cl.[2] ..... C22C 38/40

[58] Field of Search ..... 75/128 R, 129, 49

[56] References Cited

OTHER PUBLICATIONS

Grossmann, M. A., "Hardenability Calculated from Chemical Composition," Transactions of A.I.M.E., Iron & Steel Div., vol. 150, 1942, pp. 227–259.

*Primary Examiner*—P. D. Rosenberg

[57] ABSTRACT

A method of making a die steel, and the product thereof, in which melting to specified chemical ranges is subordinated to the achievement of a specified final property or properties, such as hardenability, by any combination of elements which will produce the specified final property starting from the most economical scrap mix available. Specifically, when seeking to achieve a minimum hardenability, the minimum required $D_I$ is determined and, after providing minimum qualities of elements needed to ensure attainment of essential use characteristics except hardenability, the lowest cost element which will ensure attainment of the minimum required $D_I$ is added. In the event a maximum practical upper limit of the first hardenability make-up element is reached for any reason, such as refractory attack in the case of manganese, before the required $D_I$ is achieved, the hardenability make-up element selection process may be repeated with successively more expensive elements as often as needed to reach the required $D_I$.

2 Claims, 1 Drawing Figure

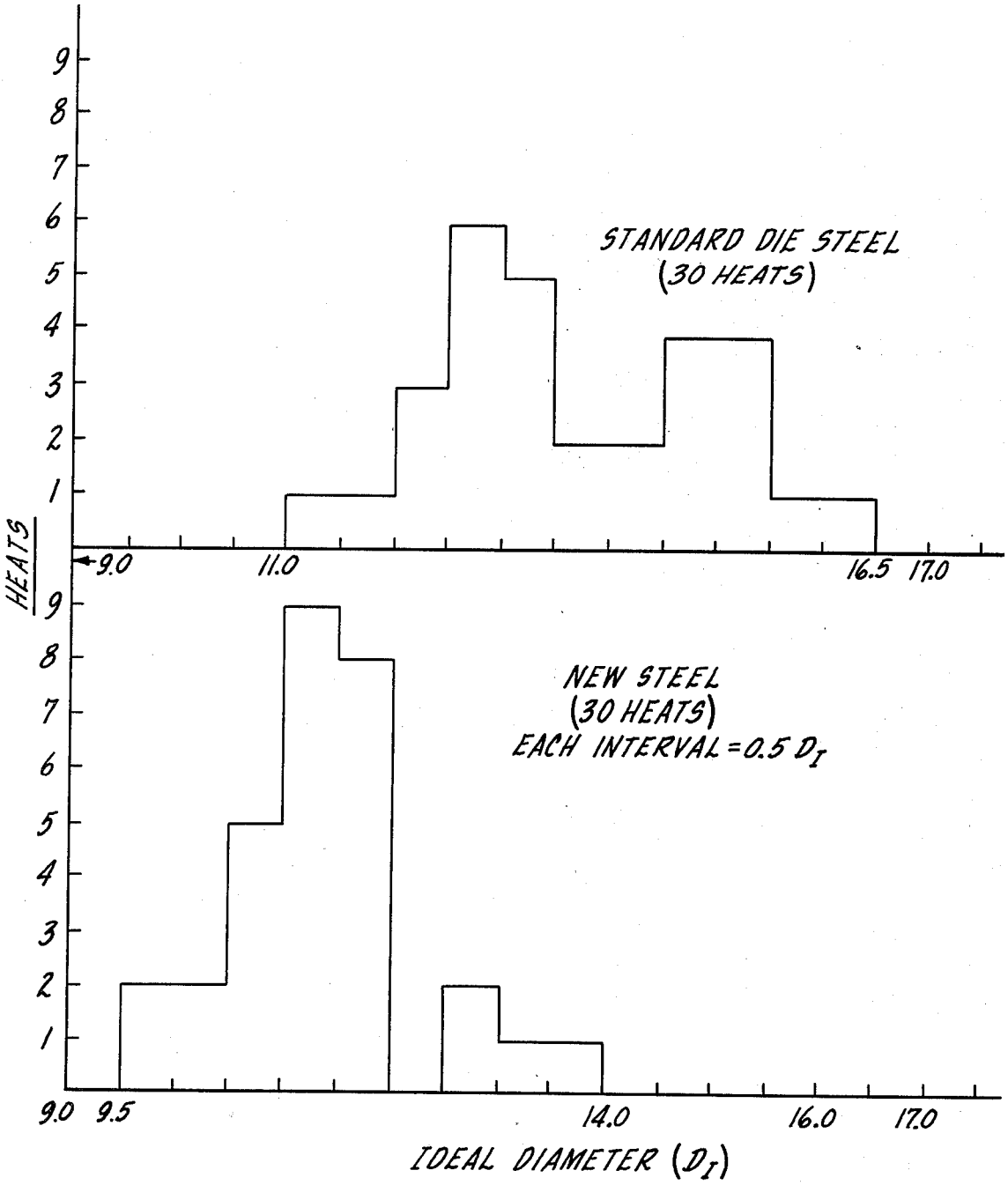
FIGURE HISTOGRAM OF HARDENABILITY CONTROL

LOW ALLOY DIE STEEL (TYPE F)

This invention relates to die steels which must possess well recognized properties for successful specific use, and to a method of formulating and making said steels based primarily on a required property, or properties, substantially independent of chemical composition except for recognized minimum amounts. More specifically, the invention relates to formulating die steels based primarily on their required hardenability.

SUMMARY OF THE INVENTION

The great bulk of die steels in use today are designed and defined primarily, if not exclusively, on the basis of chemical composition. Thus certain properties are known to result from the presence, or absence, of specific elements in specific amounts. Increased hardness (not to be confused with hardenability) and strength result from the use of increasing amounts of carbon, and increasing amounts of nickel result in increased toughness, for example. Since the performance characteristics of the ultimate product are also known, design of a die steel for particular use has heretofore resolved into a process of selecting the alloy elements which will produce the required performance property, thereby in effect translating the required properties into a chemical composition. Nearly invariably the alloy elements are expressed in terms of ranges. Thus, for example, lengthy experience in the use of hot work forging dies has established that about 0.50–0.60 C is needed to yield the requisite strength, hardness and wear resistance for maximum economic life of the die. As a result one of the most popular die steels for this usage is supplied to this range, and all competitive steels are similarly specified to a substantially similar range.

This approach to the design of die steels has certain drawbacks which are becoming more and more acute as competition increases.

Thus the manufacturer of die steels may be at a substantial cost disadvantage if he furnishes a composition in which most or all of each of the alloy elements fall near the upper end of its specified range.

There is also the ever-present problem of an off-heat resulting from one or more elements falling outside the specified ranges. The customer may reject the steel, or the die steel maker may have to scrap the heat. However, many times actual production runs using the off-heat steel will give results as good as steels melted in specification.

It is also well known that two or more elements may produce, to a greater or lesser degree, the same result in the end products. Thus, increasing quantities of each of Cr and Mo tend to increase the depth of hardening and wear resistance. However since other elements such as Cr and Ni may leave opposing characteristics which tend to cancel out, such as their respective effects on the lower critical temperature, a combination of both may be preferred over an increased amount of one to the exclusion of the other. The nearly inevitable effect of designing a die steel based on ranges has, however, in general not recognized the possibility of increasing one element with respect to another for attainment of a property common to both, or for their opposing effects. This can be of crucial economic importance when one element is substantially more expensive than another, as for example S and Ag (both of which increase machinability) but as to which S costs only a fraction as much as Ag for the same degree of beneficial effect.

Thus it is apparent that the conventional practice of designing or specifying a die steel by composition ranges raises problems of flexibility and cost for the die steel maker, especially when two or more elements are capable of yielding the same end result.

Accordingly, this invention is concerned with a new approach to die steel manufacture in which the attainment of specified ranges is subordinated to the achievement of specified final properties by any combination of elements which will achieve those final properties, starting with whatever scrap materials may be available at the commencement of production.

The invention involves the concept of determining as closely as possible the final properties the ultimate product must have, determining the minimum amounts of those essential elements that must be present, such as C, melting in with whatever scrap is available or with the most economical scrap mix if a choice is available to meet all but one or two of the required ultimate properties, testing the chemistry of the steel to determine if the minimums of the essential elements will be available in the melting vessel, and then adding a sufficient quantity of a key element of elements to achieve the final property or properties which earlier chemical testing determined would not be achieved even though the essential minimums were present. Preferably the key element or elements are elements of low cost as contrasted to the essential elements which were provided to achieve the essential chemical minimums.

Accordingly the primary object of the invention is to provide a method of making an alloy die steel applicable to any end use, and specifically a method of making a hot work forging implement and associated parts, which is less costly than methods currently employed.

Another object is to provide a general and specific method for making a die steel which makes maximum use of alloys in the scrap available at the start of production.

Another object is to provide a general and a specific method of making a die steel as described above using additions of alloys which give maximum or near maximum hardenability per dollar expended.

Yet another object is to provide a method of making a die steel in which the die steel making process, and particularly control over hardenability, is adaptable to computer programming.

A further object is to provide a die steel having required use properties at lowest cost.

Yet a further object is to provide a method of making a hot work forging implement steel in which all minimum properties, and particularly hardenability, are achieved at lowest cost.

The single FIGURE of the drawing is a histogram of hardenability control achievable by use of this invention as contrasted to the hardenability control attainable with a comparative prior art steel which was melted strictly to chemical composition.

For purposes of illustration the invention will be described in terms of the specific example of a steel intended for use as a hot work forging die. Although a hot work forging die has been chosen for purposes of illustration of the invention, it will be apparent to those skilled in the art that associated parts such as guide pins for dies, inserts, tie plates, sow blocks, ram guides and rams for drop hammers, and bolster plates for presses (all of which will hereafter be collectively included in the term "dies" and "die steel products") are included in the invention.

DETAILED DESCRIPTION OF INVENTION

The required properties of a hot work forging die have been well developed from years of experience. Such a die must have substantial strength since it is subjected to heavy stresses in the forging operation and substantial hardness to insure against premature wear. It must also have good toughness to withstand the heavy and continuous shock loads to which it is subjected in use. Due to the elevated temperatures to which it is exposed in use the die must be resistant to softening and heat checking. Abrasion resistance is also a critical factor, since in use the sliding forces exerted on the surface at elevated temperatures are very substantial.

And finally, the hardenability of the die must be as high and as uniform as possible within cost, toughness and heat treatment limits.

In practice, the cavity initially sunk in the die block from which the die is made eventually wears oversized through use. When the maximum tolerance has been reached the die is removed, the face is cut down to sound metal, and the cavity resunk in the remaining material. This may be repeated several times before the useful life of the die is exhausted. The cost of the dies, including initial cost, hammer and press down time for removal, machining and installation requires that maximum production be obtained after each re-sinking.

Now, if the die has sufficient strength and toughness to remain in service without fracture, the most important use requirement is that the die be of substantially uniform hardness throughout so the production that can be expected from the last sinking is as great as can be expected from the initial sinking.

Accordingly, in this application hardenability is the most important characteristic.

A hot work forging implement was prepared in accordance with the invention as follows.

On the basis of experience, it was determined that a C content of very close to 0.55 was best suited for this application. C, of course, provides strength and hardness to the die block. By long usage, a broad range of 0.50–0.60 C has been employed, and, on occasion, an intermediate range of 0.53–0.57 C.

Si was specified at 0.22, again based on long experience which indicates that this amount of Si contributes to cleanliness and deoxidation in the steel making process. The usual Si range for this die block usage is 0.15–0.35.

A minimum of 0.50 Ni is required to impart toughness to the steel, again based on experience.

A minimum of 0.50 Cr is required, based on experience, because of the beneficial effect Cr exerts on deep hardening, wear resistance, tempering resistance, and the elevation of the lower critical temperature.

A minimum of 0.20 Mo is required, again based on experience, due to its ability to resist softening in use, for wear resistance, and hardenability.

And finally, Mn should be present because of its very effective depth hardening ability. If present in quantities very significantly above about 2%, deleterious effects may be encountered, but up to this limit nearly any amount of manganese will exert a beneficial effect on hardenability and control sulfide hot shortness.

Now, it has long been known that hardenability can be measured and expressed mathematically, (i.e.: by the formula $\log D_I = \log F_C + \log F_{Si} + \log F_{Ni} + \log F_{Cr} + \log F_{Mo} + \log F_X$, wherein the expression $D_I$ represents the ideal critical diameter, and the expressions $F_C$, $F_{Si}$, $F_{Ni}$, $F_{Cr}$, $F_{Mo}$, and $F_X$ are factors which represent the hardenability contribution of each of the elements identified by the chemical symbol in the subscript and, with respect to $F_X$, all other elements which may be present and which contribute to hardenability, all as exemplified by the example on page 78 of Republic Alloy Steels, 1961, Republic Steel Corporation, Cleveland, Ohio,) and related to the ability of a die steel to give satisfactory performance. For example, the ideal critical diameter, hereafter referred to by its conventional abbreviation $D_I$, is often used as a measure of hardenability. Long experience in die steel usage has disclosed that a minimum $D_I$ of 9 is desirable for satisfactory die steel performance. For a more detailed discussion of hardenability and $D_I$, see Republic Alloy Steels, 1961, Republic Steel Corporation, Cleveland, Ohio, pages 75–102, wherein it will be noted that the Ideal Critical Diameter can be defined as the diameter of a round which, if quenched in a perfect quench, will harden to 50% martinsite at the center. For purposes of this invention, however, the mathematical determination of the $D_I$ as derived from calculations based on chemical composition is of basic importance, rather than any specific measurement of diameter.

After determination of (a) the alloy element or elements which must be present to make possible the attainment of the required use properties — here C, Si, Ni, Cr, Mo and Mn, and (b) the minimum amounts of the most expensive of those elements, in addition to carbon, which must be provided to attain the required end use properties, — here Ni, Cr and Mo, and (c) the $D_I$ required, the method of obtaining the required $D_I$ is as follows:

The $D_I$ factor attributable to each of C and the essential elements is determined. This is done by reference to a table giving the hardenability factor attributable to each alloy and level, adding the hardenability factor for the required C content and the hardenability factors for the aim, or required minimums, of the essential alloys (here Si, Ni, Cr and Mo), determining the hardenability factor for the required $D_I$ (here 9), determining the difference, if any, between (a) the hardenability factor of the required $D_I$ and (b) the sum of the hardenability factors for carbon and the essential alloys, and, if (b) is less than (a), determining the amount of the least expensive alloy capable of exerting a beneficial effect on hardenability, here manganese, corresponding to the aforesaid difference. In the event a maximum practical upper limit of the first hardenability make-up element is reached for any reason, such as refractory attack in the case of manganese, before the required $D_I$ is achieved, the hardenability make-up element selection process may be repeated with successively more expensive elements as often as needed to reach the required $D_I$. In the die steel of the present invention the order of addition of hardenability make-up elements on a lowest to highest cost basis would be manganese, chromium, nickel and molybdenum.

To further illustrate, and referring to a conventional Hardenability Characteristics of Alloys table and a conventional Hardenability Characteristics/$D_I$ conversion table, such as is found on pages 78 and 79 of the aforesaid reference, and a standard log/anti-log table if required, the sum of the hardenability factors corresponding to a $D_I$ of 9 is determined, which determination is derived from the sum of $1 + \log_{10} D_I$, namely 1.954.

Thereafter the hardenability factors for 0.55 C, 0.22 Si, 0.5 Ni, 0.5 Cr, and 0.2 Mo, are determined from the table as follows:

| Element | Amount, % | Hardenability Factors |
|---|---|---|
| C | .55 | .400 |
| Si | .22 | .062 |
| Ni | .5 | .073 |
| Cr | .5 | .318 |
| Mo | .2 | .204 |
| | Sum | 1.057 |

Their sum, 1.057, is subtracted from 1.954 to determine the difference of 0.897.

Since the hardenability factor for Mn of 0.897 corresponds to 1.76% Mn, the steelmaker has determined that 1.76% Mn must be present to achieve a desired $D_I$ of 9.

If the foregoing calculation indicates that more manganese must be present than would be desirable, such as, for example, a process limitation based on excessive refractory attack due to a high manganese content, then only that quantity of manganese would be added which would avoid refractory attack, and the next least expensive hardenability make-up element, here chromium, would be added to achieve the required $D_I$.

Two points concerning C should be noted.

First, the hardenability characteristics for C varies slightly with grain size. For calculation purposes a grain size of ASTM No. 7 is assumed. However, at least in the medium carbon range the variation in the hardenability factor due to grain size is not sufficiently great to significantly deleteriously affect the final result. Hence grain size, as a factor, may be disregarded.

Secondly, since a carbon aim of 0.55 is desired, the calculations may be simplified by eliminating C and its hardenability factor (here 0.400) from the equation, that is, by reducing the hardenability factor aim of 1.954 (for a $D_I$ of 9) to 1.554, and then ignoring carbon in subsequent calculations. This results in requiring calculations only for the less controllable elements such as Si, Cr, Ni, Mo and V.

If the steelmaker is unable to achieve ideal control over other elements, such as Si, the factor for such additional element or elements may be eliminated by an aim.

As a further example, the following explanation is given of how to carry out the method of this invention.

A heat of about 65 tons of steel was melted in an electric furnace with the following aim chemistry specification:

| | |
|---|---|
| C | .55 aim |
| Mn | 2 max. |
| P | .035 max. |
| S | .035 max. |
| Si | .22 aim |
| Ni | .50 min. |
| Cr | .50 min. |
| Mo | .20 min. |
| V | residual |
| Al | .02 . |

The charge consisted substantially of scrap principally containing the above elements.

Just prior to tap the heat was analysed to determine if the ladle composition would include Ni – 0.50 min., Cr – 0.50 min., and Mo – 0.20 min.

Thereafter, upon determination that one or more of the three aforesaid elements would not reach ladle specifications as mentioned in the preceding paragraph, additions were made to bring the ladle composition to the desired minimums.

Thereafter a final analysis for Ni, Cr, Mo and V (in short, all elements which contribute to $D_I$ except P and S, which roughly cancel one another) was made to ensure the ladle composition would satisfy the minimum requirements and determine the hardenability contributions of other elements in addition to Ni, Cr, Mo and V which are present.

Thereafter the expected alloy hops were added. As those skilled in the art will appreciate, alloy hops are the difference in composition between the measured element at final in furnace and at the ladle sample which occur without deliberate addition, particularly in vacuum degassed steels as a result of the reduction of alloys in the slag into the bath due to the degassing process.

Thereafter, the hardenability factors for Ni, Cr, Mo and V were determined from a hardenability characteristic table and added.

Thereafter the sum was subtracted from 1.492 which represents a $D_I$ of 9 less the hardenability factors for 0.55 C and 0.22 Si.

A Mn content corresponding to the difference determined in the preceding step was then determined, and the difference between this quantity of Mn and the measured Mn was added to the furnace just prior to tap.

Normal post-tap procedures were followed to reach 0.55 C aim and 0.22 Si aim, and the steel was vacuum degassed.

Following is a table of heats of steel which were melted according to the foregoing procedure.

TABLE I

| HEAT NO. | C | Mn | P | S | Si | Ni | Cr | Mo | V | Al | DI |
|---|---|---|---|---|---|---|---|---|---|---|---|
| 118,125 | .56 | .88 | .019 | .030 | .28 | .92 | .81 | .33 | .023 | .036 | 11.22 |
| 118,115 | .53 | .53 | .018 | .033 | .31 | .92 | .97 | .34 | .040 | .005 | 9.68 |
| 118,101 | .55 | .86 | .024 | .024 | .29 | .65 | .85 | .28 | .027 | .032 | 10.09 |
| 228,028 | .53 | .84 | .024 | .032 | .28 | .87 | .78 | .33 | .045 | .004 | 11.04 |
| 128,251 | .50 | .79 | .024 | .035 | .24 | .79 | .90 | .34 | .040 | .026 | 10.84 |
| 227,985 | .55 | .93 | .021 | .031 | .30 | .81 | .90 | .29 | .027 | .024 | 11.85 |
| 217,968 | .57 | 1.04 | .025 | .035 | .30 | .72 | .80 | .31 | .020 | .016 | 11.51 |
| 118,158 | .57 | .79 | .024 | .025 | .31 | .80 | .93 | .33 | .028 | .020 | 11.75 |
| 128,407 | .54 | .56 | .019 | .030 | .33 | .65 | 1.02 | .36 | .030 | .026 | 9.91 |
| 228,123 | .53 | .72 | .023 | .030 | .30 | .80 | .97 | .35 | .034 | .012 | 11.48 |
| 228,117 | .50 | .85 | .024 | .033 | .23 | .84 | .90 | .33 | .025 | .008 | 10.62 |
| 128,339 | .55 | .69 | .022 | .027 | .32 | .92 | .96 | .33 | .026 | .012 | 10.96 |

TABLE I-continued

| HEAT NO. | C | Mn | P | S | Si | Ni | Cr | Mo | V | Al | DI |
|---|---|---|---|---|---|---|---|---|---|---|---|
| 128,289 | .50 | 1.02 | .017 | .035 | .29 | .59 | .80 | .32 | .035 | .018 | 11.35 |

In another test a heat was prepared in accordance with the foregoing procedure to the following final chemistry (Heat No. 117,905). Heat treatment to an aim of BHN 352 was employed.

| | |
|---|---|
| C | .55 |
| Mn | 1.20 |
| P | .024 |
| S | .029 |
| Si | .28 |
| Ni | 1.01 |
| Cr | .77 |
| Mo | .27 |
| V | .033 |
| Al | .013 |

The steel was vacuum degassed in the ladle using a purging gas by a process generally illustrated and described in U.S. Pat. No. 3,236,635, although this procedure is not considered mandatory. The after-vacuum temperature was 2855°F.

By reference to the hardenability characteristic table, a $D_I$ of 13.7 was calculated which indicated the required use property could be achieved.

A 1¼ × 16 × 16 inch thick center slice was taken from the long dimension of an 16 × 16 × 18 inch block. One diagonal and one face to shank hardness traverses were taken, and 3 longitudinal tensile tests were cored and 3 transverse tensile tests were sawed from specimens from the block. The following results were obtained.

TABLE II

| HARDNESS TRAVERSE | | | | | | | |
|---|---|---|---|---|---|---|---|
| Along centerline (in. from side) | 1½ | 3¾ | 6½ | 8¼ | 10¼ | 13¾ | |
| Brinnel Dia. | 3.25 | 3.20 | 3.30 | 3.30 | 3.30 | 3.25 | |
| Along Diagonal (in. from corner) | 2 | 5½ | 9 | 11⅛ | 13½ | 17 | 20¼ |
| Brinnel Dia. | 3.20 | 3.30 | 3.30 | 3.30 | 3.30 | 3.25 | 3.30 |

It will be noted that from Table II that for a surface hardness of 3.25 BD 352 BHN this 16 × 16 × 18 inch block showed a maximum difference of 0.10 mm from surface to center.

TABLE III

TENSILE TESTS OF 16" × 16" × 18" DIE BLOCK

| | | Strength - psi | | | Per Cent in 2" | |
|---|---|---|---|---|---|---|
| Location | Direction | Tensile | Yield | Yield Ratio | Elong. | Red. of Area |
| Surface | Longitudinal | 157 | 141 | 0.89 | 15.0 | 42.8 |
| Quarter | " | 162 | 146 | 0.90 | 13.0 | 27.8 |
| Diagonal Center | " | 158 | 135 | 0.86 | 14.5 | 32.8 |
| Surface | Transverse | 165 | 148 | 0.89 | 12.5 | 27.2 |
| Quarter | " | 154 | 138 | 0.90 | 4.5 | 9.2* |
| Thickness Center | " | 152 | 129 | 0.85 | 6.5 | 12.6* |

*Irregular Fractures.

The small variation in tensile strength supports uniformity of hardness observed. The center yield ratio of 0.85 in a 16 × 16 inch section which is about 5% higher than the results obtained from a similar center section from a standard proprietary steel of the following nominal composition: C – 0.55, Mn – 0.75, Si – 0.27, Ni – 0.75, Cr – 0.90, Mo – 0.38, V – 0.05.

Charpy tests produced a general parabolic curve between a lower reading of 8 ft. lb. at 75°F and an average upper reading (two tests) of 22.5 ft.-lb. at 500°F. The steel had a transition temperature of between 100 and 200°F.

A preliminary field test using a set of die blocks made from heat No. 117,905 was used to forge diesel cranks. For the initial sinking about a 15% increase in die life was experienced over another competitive inexpensive die steel.

In summary, the invention makes maximum use of alloys in scrap, makes possible controlled hardenability through a computer program or simple arithmetic. The system lends itself to a computer program due to the empirical nature of the steel composition make-up process, and makes possible the addition of alloys which yield maximum hardenability per dollar expended.

Although several embodiments of the invention have been illustrated and described, it will at once be apparent to those skilled in the art that the invention is not limited to the precise compositions and procedures hereinabove set forth, since in many instances the illustrative examples are based on an arbitrarily selected $D_I$ of 9, and this factor may be different for different end uses. Accordingly, the scope of the invention should not be limited to the specific examples above set forth, but, rather, should be limited solely by the scope of the hereinafter appended claims when interpreted in light of the pertinent prior art.

We claim:

1. In a method of making a die steel having a minimum required hardenability, and which requires a. the following amounts of the following essential elements:

| Element | Minimum |
|---|---|
| C | .50 |
| Si | .15 |
| Ni | .50 |
| Cr | .50 |
| Mo | .20 |

the steps of b. selecting the Ideal Critical Diameter ($D_I$) which corresponds to the minimum required hardenability of the die steel, c. melting a heat of steel from raw materials to yield at least alloy elements in the heat selected from the group consisting of carbon, nickel, chromium and molybdenum, d. thereafter chemically analyzing the melt to determine the amount of each of said essential alloy elements therein, e. thereafter making additions of carbon, silicon, nickel, chromium, and molybdenum to the heat as needed to ensure the presence in the heat of the minimum amount of each of said essential elements specified in step (a), f. converting the amounts of the essential alloy elements carbon, silicon, nickel, chromium, molybdenum, and all other elements, which contribute to hardenability, to their equivalent in accordance with the formula $$\log D_I = \log F_C + \log F_{Si} + \log F_{Ni} + \log F_{Cr} + \log F_{Mo} + \log F_x;$$

g. adding the $D_I$ contributions for the individual alloy elements specified in step (f) to determine the total $D_I$ value of the heat after the additions referred to in step (e) have been made to the steel, and, in the event the resultant $D_I$ value is less than the required $D_I$ value of step (b), h. adding a hardenability make-up element or elements to the melt until the required $D_I$ of step (b) is reached, said hardenability make-up elements being added in the order of firstly, manganese, in an amount up to a maximum of about 2%, and secondly, from the group consisting essentially of chromium, nickel and manganese.

2. The method of making a die steel of claim 1 further characterized in that the required $D_I$ of step (b) is a minimum of about 9.

* * * * *